United States Patent [19]

Bush

[11] Patent Number: 4,723,434

[45] Date of Patent: Feb. 9, 1988

[54] CENTERING DEVICE FOR HYDRAULIC COMPRESSION TOOLS

[75] Inventor: Austin L. Bush, Birmingham, Ala.

[73] Assignee: Square D Company, Palatine, Ill.

[21] Appl. No.: 858,846

[22] Filed: Apr. 30, 1986

Related U.S. Application Data

[63] Continuation of Ser. No. 665,483, Oct. 29, 1984, abandoned.

[51] Int. Cl.[4] ..... B21D 7/06

[52] U.S. Cl. ..... 72/410; 72/420; 29/751; 81/421

[58] Field of Search ..... 72/410, 409, 420, 428, 72/389, 465, 470, 416; 29/751, 243, 52, 237; 30/358, 92; 83/454, 456, 458; 279/1 L; 81/421

[56] References Cited

U.S. PATENT DOCUMENTS

| | | | |
|---|---|---|---|
| 3,120,772 | 2/1964 | Mixon, Jr. | 72/40 |
| 3,234,838 | 2/1966 | Faull | 83/454 |
| 3,312,988 | 4/1967 | Shannon | 72/410 |
| 3,326,029 | 6/1967 | Porter | 72/410 |
| 3,406,558 | 10/1968 | Tillman et al. | 72/465 |
| 3,417,599 | 12/1968 | Burns | 72/416 |
| 3,523,351 | 8/1970 | Filia | 72/465 |
| 3,531,971 | 10/1970 | Robb et al. | 72/410 |
| 3,534,583 | 10/1970 | Demler | 72/410 |
| 3,571,890 | 3/1971 | Brehm et al. | 72/410 |
| 3,710,610 | 1/1973 | McCaughey | 72/410 |

*Primary Examiner*—Daniel C. Crane

*Attorney, Agent, or Firm*—Stephen A. Litchfield

[57] ABSTRACT

A compression tool head assembly for compressing a metal connector about a conductor. The assembly includes a head section having two, opposing arms moveably connected thereto, each of the arms having a compression point thereon; a rigid column disposed between the opposing arms and having a die mounted therein, the die having a compression point at one end and a mechanism for centering the cylindrical connector over the compression point at approximately a central location between the arms prior to compressing the connector; a hydraulic pump section is connected to the head section and operates to move the head section towards the rigid column; the arms have cammed surfaces which interact with rollers fixed to the rigid column to cause the arms to move towards each other as the head is moved towards the rigid column; as the arms move towards each other the compression points on the arms will compress an article disposed therebetween.

6 Claims, 7 Drawing Figures

CENTERING DEVICE FOR HYDRAULIC COMPRESSION TOOLS

This application is a continuation of application Ser. No. 665,483, filed on Oct. 29, 1984, now abandoned.

CROSS REFERENCE TO RELATED APPLICATIONS

This application is related to, but no way dependent upon two co-pending applications of common ownership and identified as: Ser. No. 424,795, filed Sept. 27, 1982, now U.S. Pat. No. 4,480,460, entitled COMPRESSION TOOL, and Ser. No. 435,775, filed Oct. 21, 1982, entitled HYDRAULIC COMMPRESSION APPARATUS.

BACKGROUND OF INVENTION

1. Field of the Invention

This invention pertains to compression tools and more particularly to hand operated compression tools adapted for exerting a large compression force upon a cylindrical connector.

2. Description of the Prior Art

A number of hydraulic compression tools have been developed for compressing metal connectors about electrical conductors to form an electrical and structural connection between two conductors, or between a conductor and a terminal. When two conductors are connected, each conductor end is inserted into an open end of a cylindrical connector. The connector is then exteriorly compressed by the hydraulic compression tool to mechanically lock the conductors to the connector and to establish electrical continuity between them.

There are currently many types of connectors in use. One type commonly used is of a cylindrical configuration, called a sleeve connector, which will connect two conductors together in a straight line. A variation of this type provides a cylindrical section with a flat portion for connection of a conductor to a terminal. Another type of connector in common use is of an "H" type design, called a parallel tap connector, which has two, parallel open sections. A conductor is inserted in each open section and then, by compression, the open ends of the connector are closed and locked over the conductors by the compression tool.

Many compression tools designed to compress cylindrical connectors utilize a plurality of opposed, pointed, nibs which are urged towards a common center as the levers of the tool are operated. Each of these nibs compress a portion of the connector onto the conductor ends. There are many different conductor diameters in use. Generally, the diameter of size of a connector will accommodate a number of conductor diameters to which it is to be joined.

When a tool that has opposing, pointed nibs is used to compress a cylindrical or sleeve type connector, many times the sleeve will not center properly between the nibs, or compression points of the tool. This is true particularly when the type of tool that is being used must have the nibs opened up to their full extent exposing a rather large open area between the compression points of the tool before the compression of the cylinder is begun. If a cylindrical connector is not properly centered between the nibs at the beginning of the compression cycle, the cylindrical connector may become jammed in between the nibs of the tool as they are compressed. If the connector is not properly centered, the compression of the connector may not form a secure mechanical and electrical connection. Also, if the cylindrical connector is not properly centered, it may jam the tool or damage it if the compression of the cylindrical connector is continued. Often, to solve this problem a lineman would open the nibs up to their most outward position and then begin to crimp the nibs together until they are approximately at the outer diameter of the cylindrical connector. Then, the cylinder is inserted into the nibs and compressed. This entails a certain amount of time and concentration by the lineman on properly aligning the cylinder or cylindrical connector within the compression area. Thus, with respect to hydraulic crimping tools that crimp cylindrical connectors and use opposing pointed nibs there is a need in the field for a device which will quickly and efficiently center and locate the cylindrical connector in the compression area of the tool. Further, there is a need in the field for a connector centering device to be used in connection with a compression tool which will not otherwise hamper the operation or effectiveness of the tool.

SUMMARY OF THE INVENTION

The above objects of the invention are satisfied by providing a centering device in combination with a nib or die which is insertable into the crimping area of the hydraulically operated hand crimping tool. The centering device comprises a V-shaped section moveably secured to one of the dies. The section is aligned on the die such that the lowest part of the V-shaped section corresponds to the compression point of the die. The V-shaped section is spring-loaded into the die such that the spring urges the V-shaped section over the compression point of the die. A cylindrical connector is cradled in the V-shaped section prior to its compression over a conductor. The cradling effect of the V-shaped section and the positioning by virtue of the spring loading of the V-shaped section serves to locate the cylindrical connector with respect to the compression point of the die and with respect to the other compression points of the tool. Since the die is insertable into the hydraulic hand tool and the V-cradling section is mounted to the die, the section is designed such that the cylindrical connector is cradled in the V-shaped section at a position where the other moveable compression points of the hand tool will also serve to connect the cylindrical connector to a conductor. As the conductor is compressed, the spring action of the V-shaped section is conpressed allowing the section to move past the compression point of the die and exposing the compression point to crimp the conductor and connector.

The placement of the V-shaped section with respect to the compression points on the arms of the compression tool allows a cylindrical connector to be centered with respect to all three compression points. The V-shaped section prevents the cylindrical connector from jamming in between the arms of the compression tool and the lower die mounted therein as has been the problem with the prior art devices. The V-shaped section comprises a pair of V-shaped flat metal or plastic sections. Each section is designed to pass through an opening in the die and to be mounted therein. Each section has a matable portion with the other section. For example, one flat section of the V-portion has a male member that corresponds and mates with a female member of the other section. A mounting pin is secured therethrough. The mounting pin also serves as a means by which a compression coil spring is loaded therein to provide the spring force against which the V-section is urged towards the compression point of the die. While in the present invention a V-shaped section is shown and disclosed, it should be noted that other designs would suffice. For example, a semi-circular section would be anticipated as providing the same function and result as the V-shaped section. However, it is felt that the V-section will accommodate a larger variety of cylindrical connector sizes than a circular section. Thus, a V-shaped section is felt to be the best mode of the invention.

DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings, in the several figures of which like reference numerals identify like elements, and in which:

DETAILED DESCRIPTION

Figure 1:
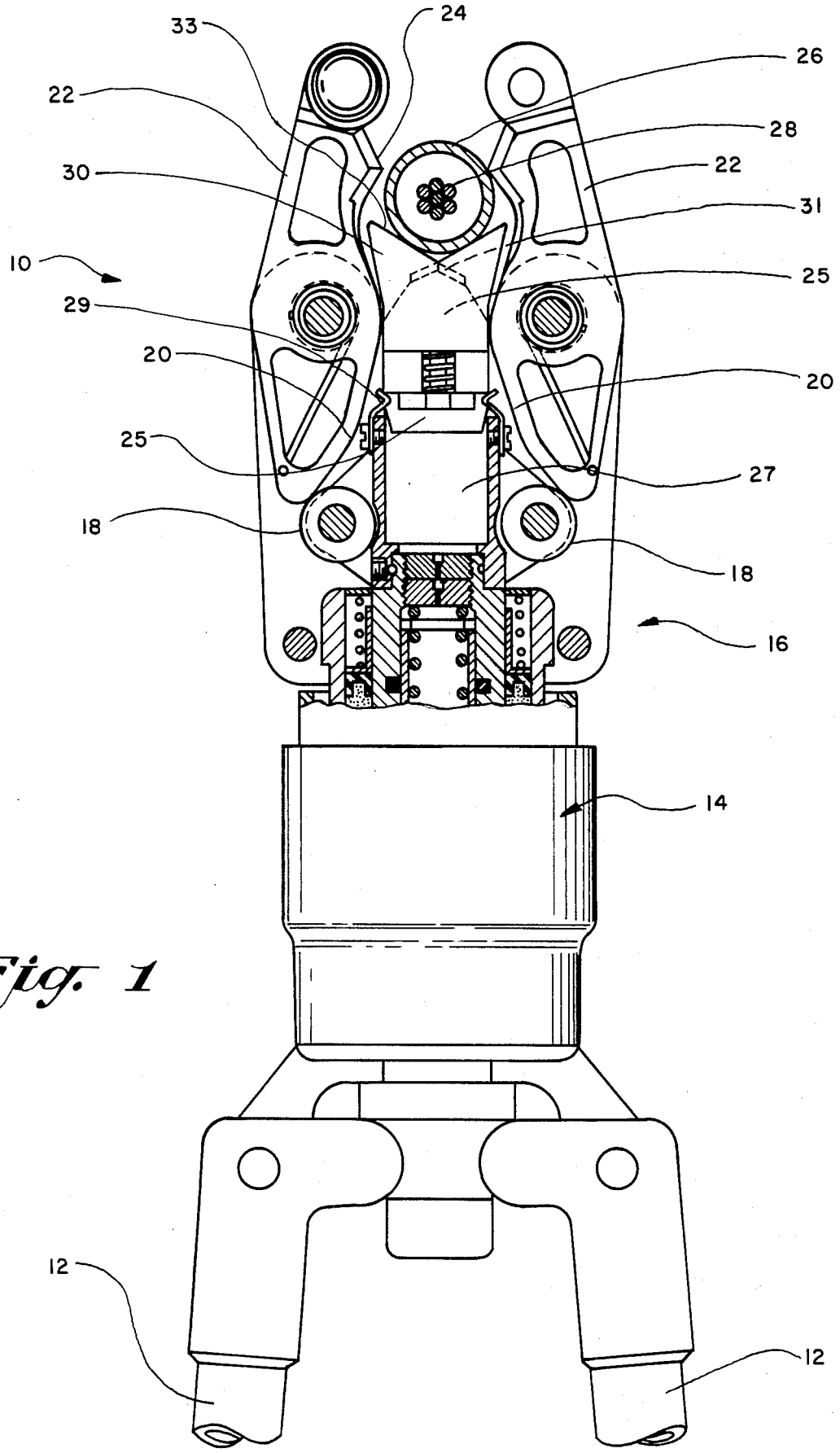
FIG. 1 illustrates in side section view the hydraulic hand tool having the centering device positioned therein.
Figure 2:
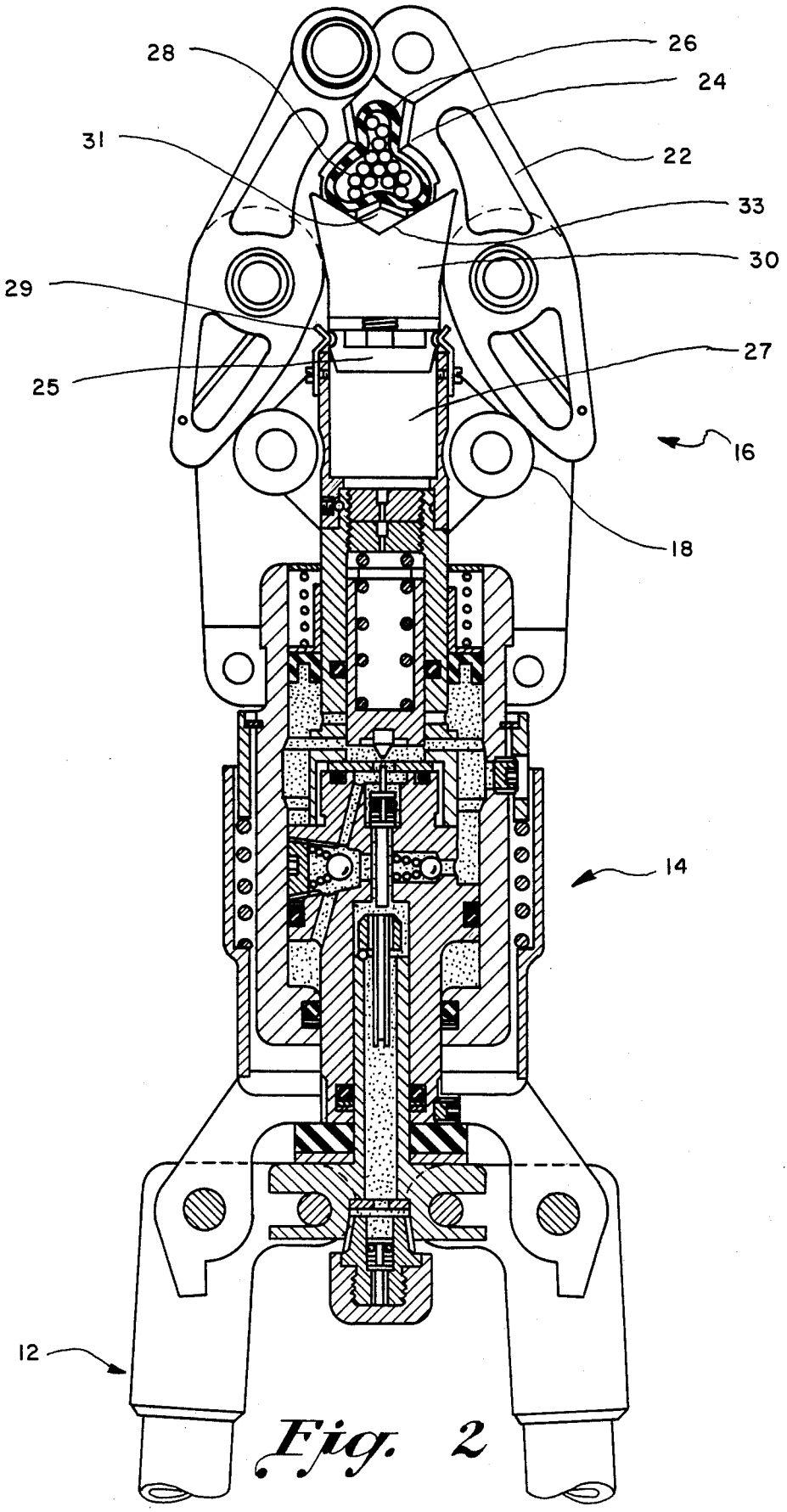
FIG. 2 illustrates in side section view the hydraulic hand tool, exposing the hydraulic apparatus of the tool, and showing the operation of the centering device as it crimps a cylindrical connector over a conductor.

The invention will now be described in greater detail. Referring to FIG. 1, hydraulic hand tool 10 is shown in side section view having arms 12, hydraulic section 14, and head section 16. The operation of the hydraulic hand tool is described in copending applications having Ser. Nos. 424,795, and 435,775. Briefly, the tool is operated by moving the arms 12 to activate hydraulic section 14 thereby causing head section 16 to move against stationary rollers 18 and causing cammed surfaces 20 of arms 22 to compress the cylindrical connector 26 shown disposed over conductor 28. The movement of head section 16 with respect to rollers 18 causes the desired movements of arms 22 against cylindrical connector 26. FIG. 2 shows in detail the end result of the movement of arms 22 against connector 26, showing the compression of the conductor 28 thus forming the mechanical and electrical bond between the connector 26 and the conductor 28.

Referring again to FIG. 1, arms 22 are shown having compression points or nibs 24. Die 25 is shown in dotted line mounted in die mounting opening 27. Centering device 30 is disposed over die 25 and is shown having cradled therein clyindrical connector 26. It is seen that by virtue of the cradling of centering device 30, the cylindrical connector 26 is positioned approximately midway between the nibs 24 of arms 22 and the compression point 31 of die 25. Die 25 is held in the die mounting opening 27 by virtue of spring clips 29. Spring clips 29 mate with depressions in die 25 which will be shown and disclosed below.

Referring now to FIG. 2, the cylindrical connector 26 is shown deformed over the conductor 28 by virtue of the movement of arms 22, and hence nibs 24, against the conductor 26. As arms 22 move against the cylindrical connector 26, pressure is generated against the centering device 30. This pressure causes the centering device to move downward as shown in FIG. 2 thereby exposing the compression point 31 of die 25. This compression point 31 acts as a third point against which the cylindrical connector 26 is compressed, thereby forming a three-way crimp. Through testing, the three-way crimp of a cylindical connector over a conductor has been found sufficient to mechanically and electrically secure the connector to the conductor.

As can be seen from FIGS. 1 and 2, the V-shaped area 33 of centering device 30 cradles the cylindrical connector 26 and positions it such that compression point 31 and nibs 24 are able to cause the desired deformation of the connector 26. Without centering device 30 and given the fact that cylindrical connectors vary in diameter, the connector 26 would often become lodged between one of the arms 22 and the die 25. When the connector 26 would be crimped in such a position, an improper and unsecure mechanical connection would be created due to the off-centering of the connector 26. The V-shaped section of centering device 30 is shown in FIG. 1 leaving little space between the centering device 30 and the inner portions of arms 22. Thus, it is difficult, if not impossible, for the cylindrical connector 26 to become lodged improperly between the die 25 and one of the arms 22.

Figure 3:
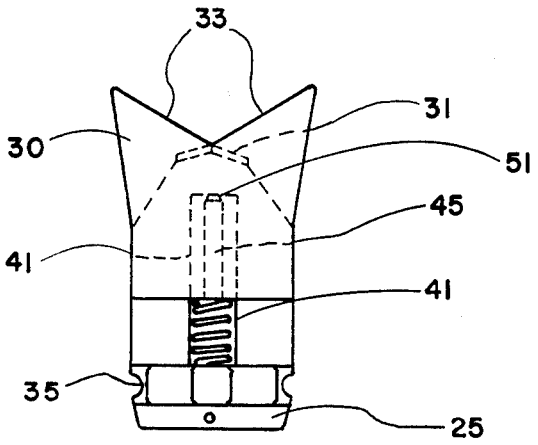
FIG. 3 shows in side view the centering device of the present invention.

The centering device 30 will now be described in more detail. FIG. 3 illustrates in side view the centering device. The V-shaped section 33 is shown disposed totally over compression point 31. Die 25 has depressions or indentations 35 therein for receiving the spring clip members 29 of the hydraulic hand tool to thereby secure the die 25 and centering device 30 into die opening 27 of the hydraulic hand tool 10.

Figure 5:
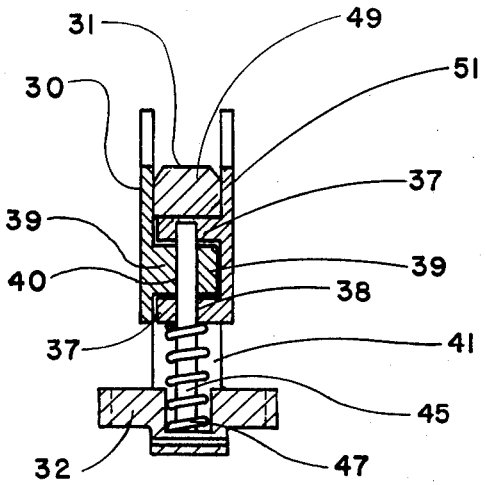
FIG. 5 shows in side section view the centering device of the present invention.

FIG. 5 shows in greater detail the various components of centering device 30 and die 25. In FIG. 5 centering device 30 is shown comprised of two separate parts. Clevis section 37 is shown mated with male section 39. Opening 41 in die 25 receives the clevis section 37 and the male section 39 of centering device 30. Pin 45 connects clevis section 37 with male section 39 of the centering device 30. The pin 45 is shown inserted in opening 41 of die 25. Compression spring 47 provides a force against which centering device 30 is urged against upper die section 49. Upper die section 49 also contains the compression point 31. Opening 41 in die 25 has upper end 51 against which the mated sections 37 and 39 of centering device 30 are urged by spring 47. FIG. 3 shows in dotted line the outline of compression point 31 and die 25 as it is covered by centering device 30. Upper end 51 of opening 41 is shown having pin 45 adjacent thereto. Spring 47 is shown urging centering device 30 over compression point 31. Opening 41 is shown containing the male section 39 and clevis sections 37 of centering device 30 therein. The interlocking nature of pin 45 in opening 41 with the male 39 and clevis 37 sections of centering device 30 locks the centering device in place over the compression point 31 of die 25. As pressure is applied to a cylindrical connector 26 as shown in FIGS. 1 and 2, the spring force of spring 47 is overcome by the pressure exerted by arms 22 against cylindrical connector 26. Since the connector 26 rests on the V-shaped section 33, the pressure exerted by arms 22 is directed onto section 33. This causes centering device 30 to move downward in opening 41 thereby compressing spring 47. This downward motion of centering device 30 exposes compression point 31 of die 25. As the crimp of connector 26 continues, the centering device 30 continues to move down so as to not interfere with the crimping process.

Rounded portion 32 of die 25 acts as a stop against which a portion of the die opening 27 operates to restrain die 25 from moving further into opening 27 shown in FIG. 2.

Figure 4:
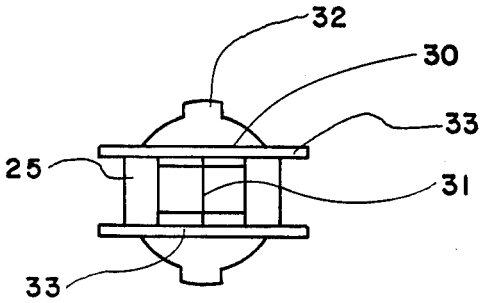
FIG. 4 shows in top view the centering device of the present invention.
Figure 7:
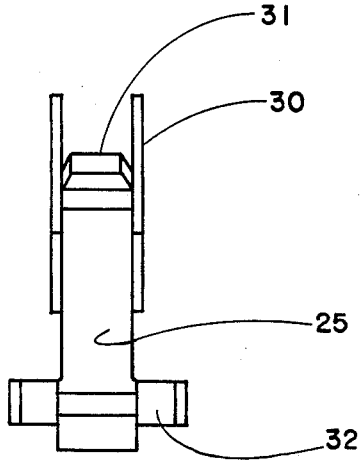
FIG. 7 shows in side view the centering device of the present invention.

In FIG. 4, a top view of the die 25 and centering device 30 is shown. As can be seen, centering device 30 comprises two parallel V-shaped sections 33 arranged adjacent to the compression point 31 of die 25. During the compression of a cylindrical connector, the parallel relationship of the V-shaped sections 33 of centering device 30 is maintained. FIG. 7 shows in side view again the parallel relationship of V-shaped sections 33 of centering device 30 and their positioning adjacent the compression point 31 of die 25.

Figure 6:
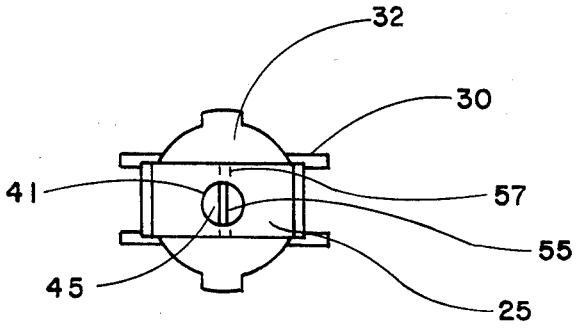
FIG. 6 shows in bottom view the centering device of the present invention.

FIG. 6 illustrates the bottom view of the centering device 30. The rounded nature of the stop 32 is shown as is the end of opening 41 through which the end of pin 45 is seen. Roll pin 55 is inserted through opening 57 in die 25. Roll pin 55 is friction fit within opening 57 such that it is not easily dislodged or moved. Roll pin 55 serves as a stop against which pin 45 is maintained in opening 41. Insertion of roll pin 55 into opening 57 after the other components of the centering device have been assembled insures that the device will remain in its assembled position with centering device 30 urged over compression point 31.

The centering device 30 and die 25 are constructed such that they may be easily removed from the hand tool 10. Spring clips 29 may be dislodged such that the indentations 35 are removed out of the bent portion of spring clips 29. Once this occurs the entire die assembly and centering device may be removed from die opening 27. This allows another die to be inserted therein if an adjustment or repair is necessary, or, as disclosed in the earlier described patent applications, the die may be replaced with a C-shaped section die and the arms 22 locked together thereby allowing for the compression and connection of an H-type connector over a pair of conductors.

The foregoing system allows a maximum flexibility for use of varying sizes of dies in the field with immediate and easy interchangeability of the die systems. The object of the present invention is satisfied by providing a centering device which maintains the cylindrical connector 26 in an approximate center position of the operative area of the tool head. It should be noted that the invention as described is not limited to the particular details of construction of the device depicted. Other modifications and applications may be made and are contemplated. For example, section 33 need not be V-shaped. It could be half-moon shaped or contain some other shape by which a cylindrical connector is prevented from becoming lodged between the die 25 and the moveable arms 22 of the hand tool 10. Also, other means for securing the centering device 30 with respect to the die 25 could be employed. The die and centering device could be intergrally formed such that the pin 45 assembly is not necessary, along with the male 39 and clevis 37 portions of centering device 30. Also, other means by which the die 25 may be secured to the hand tool 10 could be employed rather than the spring clips 29 disclosed. Certain other changes may be made in the above described device without departing from the true spirit and scope of the invention herein involved. It is intended, therefore, that the subject matter in the above depiction shall be interpreted as illustrative and not in a limiting sense.

I claim:

1. Apparatus for centering an electrical connector in a compression area of a compression tool comprising a die having a compression point at one end thereon, said die mountable in the compression tool and said die having an opening therein: means for centering a connector moveably mounted to the die in said opening, said connector centering means comprising a pair of parallel, V-shaped sections disposed on each side of and adjacent to the compression point of the die, defining a connector cradling section, said V-shaped sections having means for connecting each section to the other section in the opening in said die and means for retaining said V-shaped sections in the die, means located in said die opening for constantly urging the connector centering means adjacent the die compression point communicating with the means for connecting the V-shaped sections and comprising a spring mounted in compression in said opening in said die such that said spring exerts a force against the centering means in the direction of the compression point of the die, such that the connector cradling section acts to center a connector disposed therein directly over the compression point of the die and such that the centering means will move with respect to the die to expose the compression point of the die upon the application of pressure to the connector by the compression tool.

2. The apparatus of claim 1 where the V-shaped section connection means comprises one section having a male protrusion on one of said parallel V-shaped sections, said male protrusion having an opening therethrough and the other section having a female clevis portion, said female clevis portion mateable with the male protrusion and having an opening therethrough, said openings in the male protrusion and female clevis aligning when the male protrusion and the female clevis are mated in the die opening, a connecting pin receivable through the male protrusion and female clevis openings such that said connecting pin secures the male protrusion of the V-shaped section to the female clevis of the other V-shaped section and secures the V-shaped sections in parallel relationship to one another with the die compression point located therebetween.

3. The apparatus of claim 2 where the means for retaining the V-shaped section in the die opening comprises a roll pin inserted in an opening in the die located at an end distal from the end having the compression point, said roll pin acting as a stop against which said connecting pin rests.

4. A tool for crimping a connector comprising a pair of oppositely opposed, moveable arms each having a compression point thereon, a die having a compression point thereon and an opening therein, and mounted between said arms, said die and said arms mounted on a head section of the tool, means for moving the compression points of the arms of the tool with respect to the die and towards the compression point of the die, means for centering a cylindrical connector and a conductor to be compressed in the connector substantially at the compression point of the die such that as said arms are moved towards the compression point of the die the connector is crimped onto the conductor thereby forming a secure mechanical and electrical connection therewith, said centering means comprising a pair of parallel, V-shaped sections disposed on each side of and adjacent to the compression point of the die, said V-shaped section having means for connecting each section to the other section in the opening in said die and means for retaining said V-shaped sections in the die, means located in said die opening for constantly urging the connector centering means adjacent the die compression point, comprising a spring mounted in compression in said opening in said die such that said spring exerts a force against the centering means in the direction of the compression point of the die, such that the connector cradling section acts to center a connector disposed therein directly over the compression point of the die and such that the centering means will move with respect to the die to expose the compression point of the die upon the application of pressure to the connector by the compression tool.

5. The apparatus of claim 4 where the V-shaped section connection means comprises one section having a male protrusion on one of said parallel V-shaped sections, said male protrusion having an opening therethrough and the other section having a female clevis portion, said female clevis portion matable with the male protrusion and having an opening therethrough, said openings in the male protrusion and female clevis aligning when the male protrusion and the female clevis are mated in the die opening, a connecting pin receivable through the male protrusion and female clevis openings such that said connecting pin secures the male protrusion of the V-shaped section to the female clevis of the other V-shaped section and secures the V-shaped sections in parallel relationship to one another with the die compression point located therebetween.

6. The apparatus of claim 5 where the means for retaining the V-shaped section in the die opening comprises a roll pin inserted in an opening in the die located at an end distal from the end having the compression point, said roll pin acting as a stop against which said connecting pin rests.

* * * * *